United States Patent [19]

Walker

[11] 4,224,726

[45] Sep. 30, 1980

[54] HOT MELT CARPET SEAM ROLLER

[76] Inventor: William C. Walker, 2142 Yosemite Dr., Milpitas, Calif. 95035

[21] Appl. No.: 34,660

[22] Filed: Apr. 30, 1979

[51] Int. Cl.[3] ..... B30B 3/00; B22F 3/18

[52] U.S. Cl. ..... 29/121.1; 29/110.5; 29/116 R

[58] Field of Search ..... 29/121.1, 110.5, 125, 29/116 R

[56] References Cited

U.S. PATENT DOCUMENTS

| | | | |
|---|---|---|---|
| 1,819,375 | 8/1931 | Matthews | 29/116 R UX |
| 2,347,967 | 5/1944 | Rooney | 29/121.1 |
| 2,693,893 | 11/1954 | Rice et al. | 29/110.5 |

FOREIGN PATENT DOCUMENTS

| | | | |
|---|---|---|---|
| 80213 | 5/1952 | Norway | 29/110.5 |

*Primary Examiner*—James Kee Chi

*Attorney, Agent, or Firm*—Jack M. Wiseman

[57] ABSTRACT

A hot melt carpet seam roller comprising a handle. At one end of the handle is disposed a support member with an opening. Received by the opening in the support member is an axle. The axle is divided into two sections. Each section of the axle is directed away from the handle at an angle approximately 5° from the axis of the opening formed in the support member so that the converging angle therebetween is approximately 170°. A first set of nylon discs is mounted on one section of the axle with the axes thereof coincident with the axis of the one section of the axle. A second set of nylon discs is mounted on another section of the axle with the axes thereof coincident with the axis of the other section of the axle. The peripheral surface of each disc is formed with radially disposed, angularly spaced teeth. When the roller is used behind a hot melt iron, the roller presses a carpet into the molten hot melt adhesive. The angularly disposed sections of the axle enable the discs to draw contiguous carpets forming a seam closer together and cause the adhesive to draw up to the seam joint at the location of the separation.

12 Claims, 8 Drawing Figures

HOT MELT CARPET SEAM ROLLER

BACKGROUND OF THE INVENTION

The present invention relates in general to tools employed in the laying of carpets and more particularly to a hot melt carpet seam roller.

Hot melt seaming irons have been heretofore employed for forming seams from contiguous sections of carpets. Such rollers have been heretofore manufactured and sold by Burgess Tape Co. Many methods have been heretofore used for pressing contiguous sections of carpet into the hot melt adhesive tape to form seams from contiguous sections of carpet. Such well-known methods have heretofore used tool trays, flat boards, weighted flat pieces of iron and hand rollers. Hot melt carpet seam rollers have also been made with metal star disc wheels. The Orcon Company has produced a hot melt carpet seam roller comprising metal star disc wheels. The Gundlock Corporation has manufactured and sold a hot melt carpet seam roller with metal star disc wheels mounted on axles.

The U.S. patent to Rice et al., U.S. Pat. No. 2,693,893, issued on Nov. 9, 1954, for a Tool For Use In Resurfacing Room Enclosures discloses a tool used to assist in the application of flexible sheets of wall covering, such as wallpaper, for reinforcing room enclosures. The tool comprises rotatable cylindrical rollers mounted on respective axles for rotation. The angle between each axle and the longitudinal axis of the frame is between 85° and 88°, when an acute angle is desired. When an obtuse angle is desired, the angle between each axle and the longitudinal axis of the frame is between 92° and 95°. The angle was selected to avoid slippage that occurs from two small an angle and to avoid bunching and tearing which occurs when the angle is too large. The selected angle permitted the application of force by the rollers to effectively position wallpaper to a wall to form a butt seam.

In the U.S. patent to Sparks, U.S. Pat. No. 3,617,082, issued on Nov. 2, 1971, for Carpet Roller, there is disclosed a carpet roller for tacking a carpet to a tack strip. The carpet roller has toothed wheels which are adapted to slide over and between the tacks of a tack strip without damaging the tacks and while depressing the mat of a carpet between the tacks.

Norwegian Pat. No. 80213 to Gunnar Nilsen issued on May 12, 1952, shows a handle with an angle disposed at one end of the axle. It appears that the axle is formed with two sections. Each section of the axle is directed away from the handle. The angle between the two sections of the axle appears to be 135°. A roller is mounted on each section of the axle.

U.S. Pat. No 3,899,801 and 3,981,042 were issued to Vernon J. Carrier. U.S. Pat. No. 3,899,801 issued on Aug. 19, 1975, for Castor For Use With Pile Carpet. U.S. Pat. No. 3,981,042 issued on Sept. 21, 1976, for Pile Carpet Castor. Disclosed in U.S. Pat. No. 3,899,801, is a castor for use on a pile carpet that comprises a plurality of separate spaced bosses extending from the surface of the cylindrical roller. The U.S. Pat. No. 3,981,042 discloses a castor for use with jute carpet, which comprises a plurality of separate wheels located on a sleeve. The sleeve is rotatably mounted on an axle. The wheels are formed with bosses extending from the periphery thereof to engage a jute carpet.

SUMMARY OF THE INVENTION

A carpet seam roller includes a handle. A roller is mounted on one end of the handle. The roller comprises an axle having sections directed away from the handle and toward one another in which the angle therebetween is in the range of 140°-175°. A plurality of carpet engaging discs is mounted on each axle section for rotation with the axes of the carpet engaging discs coincident with the axis of the axle section along which they are mounted.

A feature of the present invention is that each carpet engaging disc is formed with radially disposed, angularly spaced teeth along the periphery thereof.

The roller of the present invention causes the carpets which it engages to move together to form a seam between contiguous carpets. By virtue of the present invention, contiguous carpets are drawn closer together in forming the seam. Heretofore, adhesive was collected below the joining edges. As a consequence of the present invention, the adhesive is drawn up to join the seam at the location of the separation or the split, which is the natural location of the seam, rather than having the adhesive remain below the natural location of the seam.

DESCRIPTION OF THE PREFERRED EMBODIMENT

Figure 1:
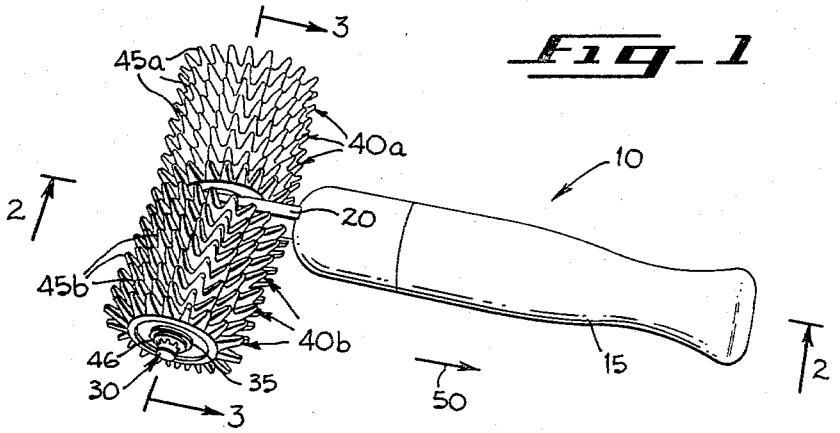
FIG. 1 is a perspective view of a carpet seam roller embodying the present invention.
Figure 2:
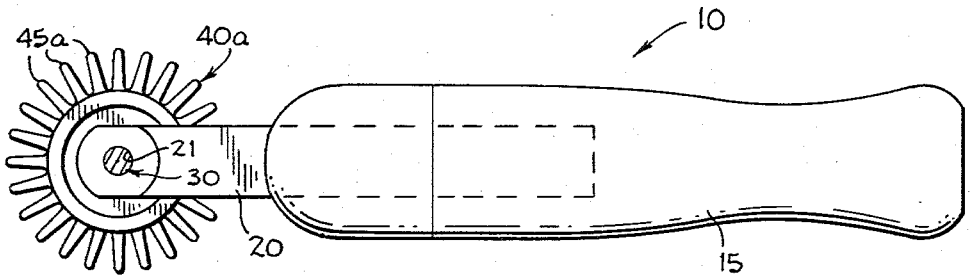
FIG. 2 is a vertical sectional view of the carpet seam roller shown in FIG. 1 taken along line 2—2 of FIG. 1.

Illustrated in FIG. 1 is the hot melt carpet seam roller 10 embodying the present invention, which comprises a suitable handle 15. Fixed to one end of the handle 15 is an axially extending member 20. At the free end of the member 20 is a cylindrical opening 21 which has an axis disposed at right angles to a longitudinal axis of the handle 15. The opening 21 may be of a suitable configuration to accommodate a central portion of an axle 30.

In the exemplary embodiment the axle 30 is received by the opening 21 and is fixed to the support member 20. The support member 20 at the free end thereof is recessed along each side thereof and tapered in a direction away from the handle 15 to accommodate washers 35 mounted on the axle 30.

Figure 3:
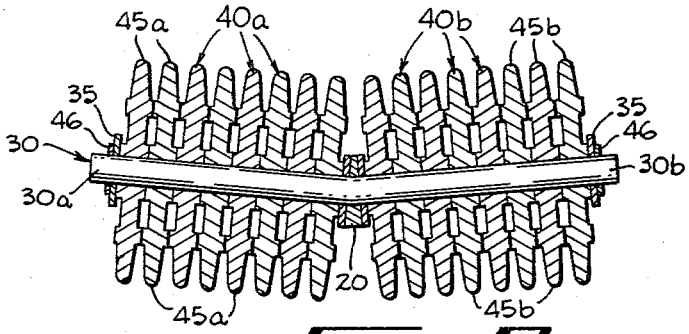
FIG. 3 is a horizontal sectional view of the carpet seam roller shown in FIG. 1 taken along line 3—3 of FIG. 1.
Figure 4:
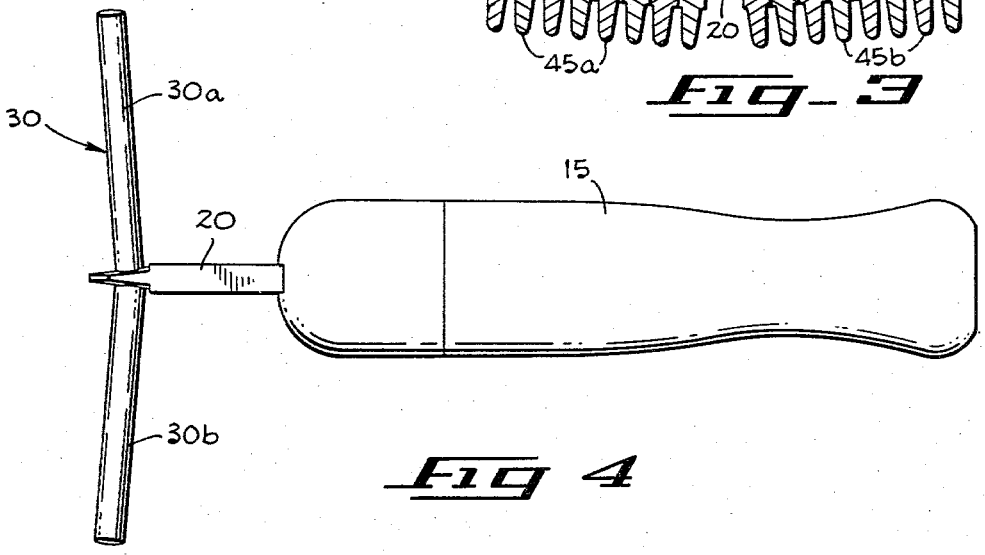
FIG. 4 is a fragmentary top view of the carpet seam roller shown in FIG. 1 with the roller discs thereof removed.
Figure 5:
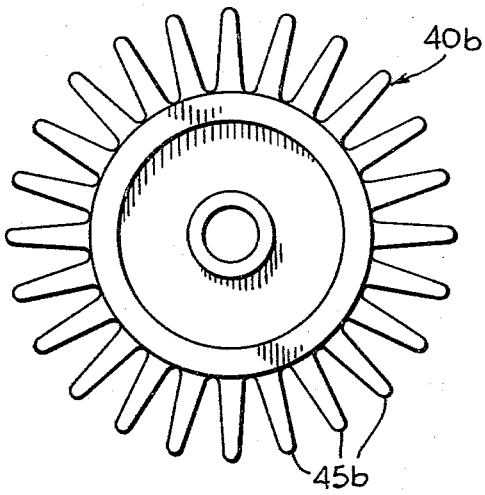
FIG. 5 is a side elevation view of a carpet engaging disc employed in the carpet seam roller shown in FIG. 1.
Figure 6:
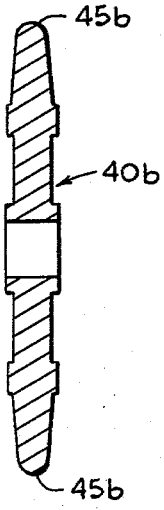
FIG. 6 is a radial section view of the disc shown in FIG. 5.
Figure 7:
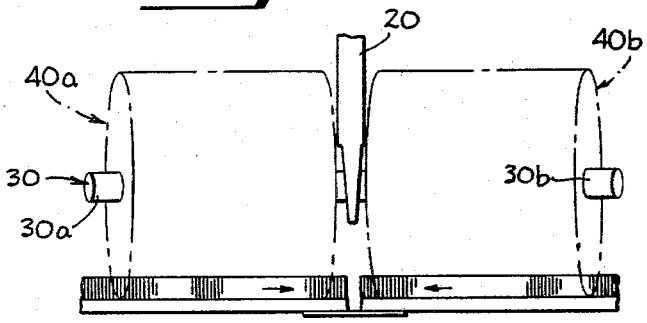
FIG. 7 is a diagrammatic illustration of the carpet seam roller shown in FIG. 1 drawing carpets together to form a seam.

According to the present invention, the axle 30 is formed into two sections **30*a* and 30*b*. The axle sections 30*a* and 30*b* are directed toward one another and away from the handle (FIGS. 3 and 4). The angle between the axis of the axle section 30***a* and the axis of the opening 21 is in the range of 2½°–30°. Similarly, the angle between the axis of the axle section 30*b* and the axis of the opening 21 is in the range of 2½°–30°. In the preferred embodiment, the axis of each axle section 30*a* and 30*b* will be directed with respect to the axis of the opening 21 at the same angle. The range of angles between the axes of converging axle sections 30*a*–30*b* is between 140°–175°. In the preferred embodiment, the angle between the axis of the opening 21 and the axis of each of the axle sections 30*a* and 30*b* taken individually is 5° and in the preferred embodiment the angle between the axes of the converging axle sections 30*a* and 30*b* is 170°. In an exemplary embodiment, the angle between the axis of the opening 21 and the axis of each of the axle sections 30*a* and 30*b*, respectively, is 7½° and in the exemplary embodiment the angle between the axes of the converging axle sections 30*a* and 30*b* is 165°.

A first set of carpet engaging discs comprised of discs 40*a* is mounted on the axle section 30*a* for rotating with the axes thereof coincident with the axis of axle section 30*a*. A second set of carpet engaging discs comprised of discs 40*b* is mounted on the axle section 30*b* for rotation with the axes thereof coincident with the axis of the axle section 30*b*. In the preferred embodiment, each disc 40*a* and 40*b* is made of a hard or rigid nylon and is formed, respectively, with radially disposed, angularly spaced teeth 45*a* and 45*b* along the periphery thereof. The teeth 45*a* and 45*b* are suitably shaped for gripping carpet. The carpet engaging discs 40*a* and 40*b* are conventional and well-known in the art. Each end of the axle 30 is suitably capped by retaining means 46 (FIG. 3) for retaining the discs 35*a* and 35*b* on the axle sections 30*a* and 30*b*, respectively. In the preferred embodiment, the discs 35*a* and 35*b* are freely rotatable about the axle sections 30*a* and 30*b*, respectively.

Figure 8:
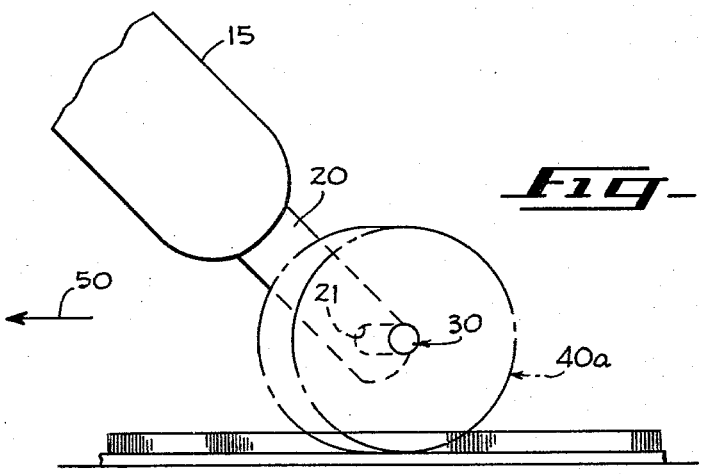
FIG. 8 is a diagrammatic illustration of the carpet seam roller shown in FIG. 1 engaging a carpet during the seam forming operation thereof.

The hot melt carpet seam roller 10 is employed after a hot melt iron is used. The roller 10, through the discs 40*a* and 40*b*, engages the carpet and presses the carpet into a molten hot melt adhesive. In the preferred embodiment, the longitudinal axis of the handle 15 is disposed at approximately a 45° angle from the generally horizontal surface of the carpet (FIG. 8). The roller 10 is moved away from the hot melt iron in the direction shown by an arrow 50 in FIGS. 1 and 8.

When the roller 10 is employed in the maneuver above described, it causes the carpets which it engages through the discs 40*a* and 40*b* to move together to form a seam between contiguous carpets. The contiguous carpets are drawn together to form a seam. The molten hot melt adhesive is drawn up to join the seam at the location of the separation or the split, which is the natural location of the seam, rather than having the adhesive remain below the natural location of the seam. The discs 40*a* and 40*b* draw the carpets toward the seam in a direction at right angles to the direction of the seam.

In the exemplary embodiment, each of said discs 40*a* and 40*b* is two inches in diameter and each tooth 45*a* and 45*b* is ⅜ of an inch in length. The tip of each tooth 45*a* and 45*b* is rounded and tapers to a reduced cross-sectional area in the radial direction away from the axis of the associated disc. The angular space between center lines of successive teeth is 15°. The cross sectional areas of each tooth is generally rectangular.

I claim:

1. A carpet seam roller comprising:

(a) a handle with a longitudinal axis;

(b) an axle at one end of said handle extending generally in the transverse direction relative to the longitudinal axis of said handle, said axle being formed with a plurality of sections converging toward one another in the direction toward said handle, the angle between the axes of said converging sections of said axle being in the range of 140° to 175°;

(c) a first plurality of carpet engaging discs mounted for rotation on one section of said axle with the axes thereof coincident with the axis of said one section; and (d) a second plurality of carpet engaging discs mounted for rotation on another section of said axle with the axes thereof coincident with the axis of said other section.

2. A carpet seam roller as claimed in claim 1 wherein said handle comprises a support member at said one end thereof extending from said handle in the direction of the longitudinal axis thereof and connected to said axle intermediate the ends thereof for supporting said axle.

3. A carpet seam roller as claimed in claim 2 wherein said support member is formed with an opening therethrough having an axis extending transversely to the longitudinal axis of said handle for receiving said axle to support said axle through said support member.

4. A carpet seam roller as claimed in claim 3 wherein the axis of said one section of said axle and the axis of said other section of said axle, respectively, is disposed at an angle in the range of 2½°–30° relative to the axis of said opening formed in said support member.

5. A carpet seam roller as claimed in claim 4 wherein each of said carpet engaging discs of said first and second plurality of carpet engaging discs is formed with a plurality of radially disposed, angularly spaced carpet engaging teeth along the periphery thereof.

6. A carpet seam roller as claimed in claim 1 wherein each of said carpet engaging discs of each of said first and second plurality of carpet engaging discs is formed with a plurality of radially disposed, angularly spaced carpet engaging teeth along the periphery thereof.

7. A carpet seam roller as claimed in claim 2 wherein said support member at the location of its connection with said axle is tapered inwardly in a direction away from said handle at the opposing walls thereof confronting said axle sections, respectively.

8. A carpet seam roller as claimed in claim 3 wherein said support member at the location of its connection with said axle is tapered inwardly in a direction away from said handle at the opposing walls thereof confronting said axle sections, respectively.

9. A carpet seam roller comprising:

(a) a handle with a longitudinal axis;

(b) an axle at one end of said handle extending generally in a transverse direction relative to the longitudinal axis of said handle, said axle being formed with a plurality of sections converging toward one another in the direction toward said handle, the angle between the axes of said converging sections of said axle being 170°;

(c) a first plurality of carpet engaging discs mounted for rotation on one section of said axle with the axes thereof coincident with the axis of said one section; and (d) a second plurality of carpet engaging discs mounted for rotation on another section of said axle with the axes thereof coincident with the axis of said other section.

10. A carpet seam roller comprising:

(a) a handle with a longitudinal axis;

(b) an axle at one end of said handle extending generally in a transverse direction relative to the longitudinal axis of said handle, said axle being formed with a plurality of sections converging toward one another in the direction toward said handle, the angle between the axes of said converging sections of said axle being 165°;

(c) a first plurality of carpet engaging discs mounted for rotation on one section of said axle with the axes thereof coincident with the axis of said one section; and (d) a second plurality of carpet engaging discs mounted for rotation on another section of said axle with the axes thereof coincident with the axis of said other section.

11. A carpet seam roller comprising:

(a) a handle with a longitudinal axis;

(b) an axle at one end of said handle extending generally in a transverse direction relative to the longitudinal axis of said handle, said axle being formed with a plurality of sections converging toward one another in the direction toward said handle, the angle between the axes of said converging sections of said axle being 170°;

(c) a first plurality of carpet engaging discs mounted for rotation on one section of said axle with the axes thereof coincident with the axis of said one section; and (d) a second plurality of carpet engaging discs mounted for rotation on another section of said axle with the axes thereof coincident with the axis of said other section;

(e) said handle comprising a support member at said one end thereof extending from said handle in the direction of the longitudinal axis thereof and connected to said axle intermediate the ends thereof for supporting said axle, said support member being formed with an opening therethrough having an axis extending transversely to the longitudinal axis of said handle for receiving said axle to support said axle through said support member, the axis of said one section of said axle and the axis of said other section of said axle, respectively, being disposed at an angle of 5° relative to the axis of said opening formed in said support member.

12. A carpet seam roller comprising:

(a) a handle with a longitudinal axis;

(b) an axle at one end of said handle extending generally in a transverse direction relative to the longitudinal axis of said handle, said axle being formed with a plurality of sections converging toward one another in the direction toward said handle, the angle between the axes of said converging sections of said axle being 165°;

(c) a first plurality of carpet engaging discs mounted for rotation on one section of said axle with the axes thereof coincident with the axis of said one section; and (d) a second plurality of carpet engaging discs mounted for rotation on another section of said axle with the axes thereof coincident with the axis of said other section;

(e) said handle comprising a support member at said one end thereof extending from said handle in the direction of the longitudinal axis thereof and connected to said axle intermediate the ends thereof for supporting said axle, said support member being formed with an opening therethrough having an axis extending transversely to the longitudinal axis of said handle for receiving said axle to support said axle through said support member, the axis of said one section of said axle and the axis of said other section of said axle, respectively, being disposed at an angle of 7½° relative to the axis of said opening formed in said support member.

* * * * *